US006817217B2

(12) United States Patent
McGuire et al.

(10) Patent No.: US 6,817,217 B2
(45) Date of Patent: Nov. 16, 2004

(54) OVERMOLDED KEY INCLUDING AN ORNAMENTAL ELEMENT AND METHOD OF MAKING SAME

(75) Inventors: Ronald J. McGuire, Slinger, WI (US); Russell J. Winberg, Wauwatosa, WI (US); Juliann Egide, Pewaukee, WI (US)

(73) Assignee: Strattec Security Corporation, Milwaukee, WI (US)

( * ) Notice: Subject to any disclaimer, the term of this patent is extended or adjusted under 35 U.S.C. 154(b) by 0 days.

(21) Appl. No.: 10/342,126

(22) Filed: Jan. 14, 2003

(65) Prior Publication Data

US 2003/0159481 A1 Aug. 28, 2003

Related U.S. Application Data

(63) Continuation of application No. 09/713,886, filed on Nov. 15, 2000, now Pat. No. 6,523,380.

(51) Int. Cl.[7] ..... E05B 19/04

(52) U.S. Cl. ..... 70/408; 70/278.3; 70/395; 70/413

(58) Field of Search ..... 70/408, 395, 278.1–278.7, 70/413, 276, 277, 279.1, 280–283, 283.1, 460; 40/330, 634

(56) References Cited

U.S. PATENT DOCUMENTS

| | | | | | |
|---|---|---|---|---|---|
| 1,438,839 | A | * | 12/1922 | Levey | 70/460 |
| 1,868,563 | A | * | 7/1932 | Cicourel | 40/330 |
| 4,305,267 | A | * | 12/1981 | Nish et al. | 70/460 X |
| 4,336,701 | A | * | 6/1982 | Raymond | 70/395 |
| 4,472,954 | A | * | 9/1984 | Kichise | 70/408 |
| 4,562,712 | A | * | 1/1986 | Wolter | 70/456 R |
| 4,726,205 | A | * | 2/1988 | Allerdist et al. | 70/395 |
| 4,768,362 | A | * | 9/1988 | Schmalz, Jr. | 70/408 |
| 4,868,409 | A | * | 9/1989 | Tanaka et al. | 70/271 X |
| 4,936,896 | A | * | 6/1990 | Takatsuka | 70/432 |
| 5,232,528 | A | * | 8/1993 | Reznickenko et al. | 70/460 X |
| 5,311,757 | A | * | 5/1994 | Spahn | 70/460 X |
| 5,337,588 | A | * | 8/1994 | Chhatwal | 70/408 X |
| 5,433,096 | A | * | 7/1995 | Janssen et al. | 70/395 X |
| 5,632,168 | A | * | 5/1997 | Yano | 70/408 X |
| 5,732,579 | A | * | 3/1998 | D'Hont et al. | 70/395 X |
| 5,768,925 | A | * | 6/1998 | Ozawa et al. | 70/408 |
| 5,870,917 | A | * | 2/1999 | Mahot et al. | 70/408 |
| 6,035,677 | A | | 3/2000 | Janssen et al. | 70/278.3 |
| 6,089,060 | A | * | 7/2000 | Steeley | 70/460 X |
| 6,094,954 | A | * | 8/2000 | Carmen | 70/408 |
| 6,164,101 | A | * | 12/2000 | Kito et al. | 70/408 X |
| 6,308,542 | B1 | * | 10/2001 | Bolton | 70/460 X |
| 6,523,380 | B1 | * | 2/2003 | McGuire et al. | 70/408 |

FOREIGN PATENT DOCUMENTS

| | | | | |
|---|---|---|---|---|
| GB | 2260565 | * | 4/1993 | 70/460 |

* cited by examiner

*Primary Examiner*—Lloyd A. Gall
(74) *Attorney, Agent, or Firm*—Michael Best & Friedrich LLP

(57) ABSTRACT

A vehicle ignition key having an ornamental element molded onto the key. The key includes a key blank and an undermold which is formed by molding a first plastic material over a portion of a key blank, defining a mounting surface for the element. The ornamental element is located on the mounting surface and secured to the heel portion of the key blank by an overmold which is formed by molding a second plastic material over the heel portion of the key blank, the undermold, and at least a portion of the element. In one embodiment, the overmold material covers substantially the entire peripheral edge of the element.

20 Claims, 9 Drawing Sheets

OVERMOLDED KEY INCLUDING AN ORNAMENTAL ELEMENT AND METHOD OF MAKING SAME

This is a continuation of U.S. patent application Ser. No. 09/713,886 filed on Nov. 15, 2000 and issued on Feb. 25, 2003 as U.S. Pat. No. 6,523,380, the entire disclosure of which is incorporated herein by reference.

BACKGROUND OF THE INVENTION

The present invention relates generally to vehicle keys, and more particularly to a vehicle key of the type including a molded head portion and to a method of making the key.

Many automobile keys include a decorative, essentially flat metal or plastic element bearing the crest of an automotive manufacturer. The ornamental element, commonly referred to as a "jewel", is provided to give the key a luxury appearance. In the prior art, the head portion of the key is molded to produce a generally flat surface on which the "jewel" is adhesively secured.

The keys for mid to high level automobile lines generally include a transponder which is molded into the key as part of a passive anti-theft system (PATS). Typically, the keys are produced using a two-stage molding process. In the first stage of the molding process, a first plastic material is molded onto a key blank to form an undermold that secures the transponder to the metal heel end portion of the key blank. The transponder is placed in the mold along with the key blank and the undermold material is introduced into the mold during the first stage of the molding process. In the second stage of the molding process, a second plastic material is molded over the heel end of the key, the undermold and the transponder to produce an overmold which encapsulates the transponder and provides a finished outer surface for the handle or grip portion of the key. The overmold also defines a generally flat mounting surface for the element. In an alternative two-step molding process, the first stage of the molding process is used to produce a retaining area into which the transponder is placed. Then, the transponder is secured in the second stage of the molding process. The outer material also defines a mounting surface for the element. Examples of this technology are disclosed in U.S. Pat. No. 6,035,677, which is assigned to the assignee of the instant application.

The surface onto which the element is adhesively secured is generally created during the second stage of the molding process. If the outer material is too soft, the surface onto which the element is secured can be created in the first stage of the molding process.

The surface area of the overmold is typically recessed somewhat into the surface of the key so that the ornamental element is recessed in the key head when it is glued onto the key, thereby increasing the chances that it will not be knocked loose by a blow to the edge of the "jewel." However, all too often, after some period of use the element will become detached from the key, giving the key an appearance which is decidedly not conducive to the luxury image that an automobile manufacturer wishes to project.

SUMMARY OF THE INVENTION

The disadvantages and limitations of the background art discussed above are overcome by the present invention. With this invention, there is provided a key having an ornamental element molded onto the key. The key includes a key blank, and a first plastic material molded over a portion of the key blank, defining a mounting surface for a element which is positioned on the mounting surface. A second plastic material is molded over the portion of the key blank and a portion of the element, securing the element to the key blank. In one embodiment, the second plastic material covers substantially the entire peripheral edge of the element. The use of a molding process to secure the element to the key results in a much more secure connection between the element and the key than is obtained by the prior art technique of using an adhesive.

In accordance with another aspect of the invention, there is provided a method of making a vehicle key of the type including a head portion containing a ornamental element. The method includes the steps of providing a key blank, providing a support on a portion of the key blank defining a mounting surface for the ornamental element, positioning the ornamental element on the support in the mounting surface thereof, and molding a plastic material over the portion of the key blank and a portion of the element and the support to secure the element to support on the key blank. In one embodiment, the method further includes causing the overmold material to cover only a peripheral edge of the element.

In accordance with the invention, forming the support includes conforming the mounting surface to the shape of a surface of the element. In addition, forming the support includes providing locating members for centering the element on the mounting surface and for preventing the element from moving during the overmolding step of the process.

DESCRIPTION OF THE DRAWINGS

These and other advantages of the present invention are best understood with reference to the drawings, in which.

DETAILED DESCRIPTION OF THE PREFERRED EMBODIMENTS

Figure 1:
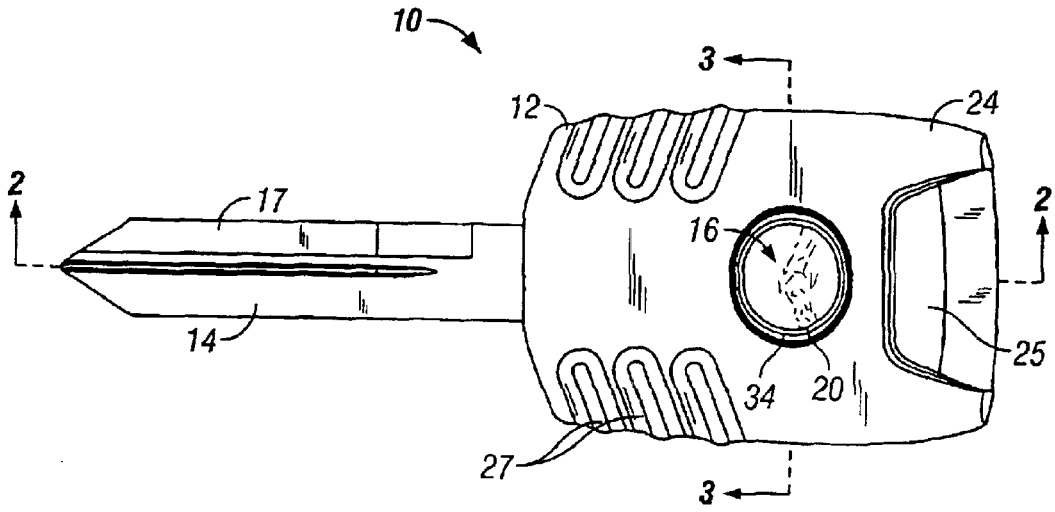
FIG. 1 is a side view of a vehicle key provided by the present invention.
Figure 2:
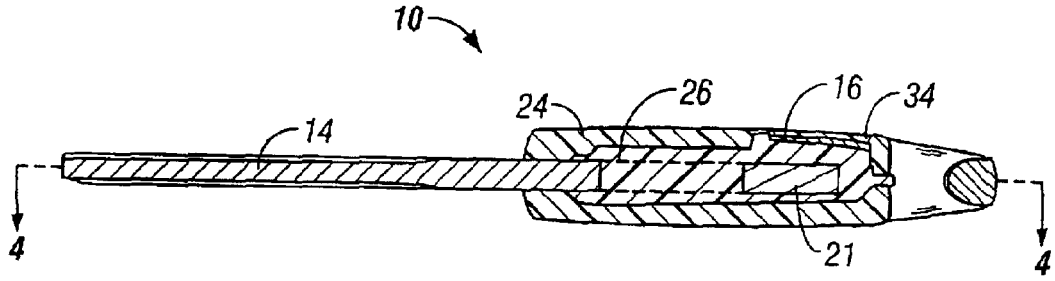
FIG. 2 is a transverse section view taken along the line 2—2 of FIG. 1.
Figure 3:
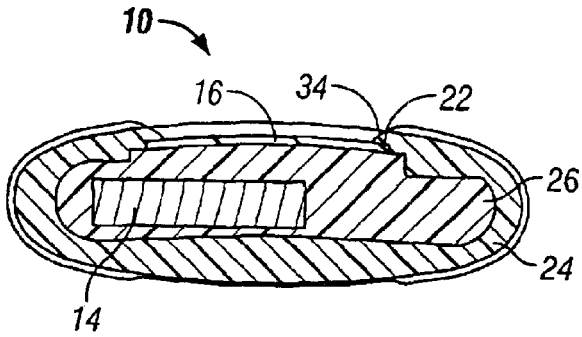
FIG. 3 is a section view taken along the line 3—3 of FIG. 1.

Referring to FIGS. 1–3 of the drawings, there is shown one embodiment of a key 10 provided by the invention. By way of illustration, the key 10 is described with reference to an application as a vehicle ignition key. However, the method of the present invention can be used in making other types of keys. The key 10 includes a head portion 12 of a plastic material 24 and a blade or shank portion 14. The head portion 12 contains a decorative or ornamental element 16, bearing indicia 20. The indicia 20 can be the crest of an automotive manufacturer, for example, or alphanumeric or numeric indicia or other designs. The head portion 12 can include an opening 25 there through to allow the key 10 to be attached to a key chain, a key fob and the like. Also, the head portion 12 can be formed with one or more outwardly projecting ribs 27 to make gripping of the key easier for a user.

In accordance with the invention, the ornamental element 16 is secured to the head portion 12 of the key by molding the plastic material 24 over a portion of the element 16 as will be shown. In one embodiment, the ornamental element 16, which is sometimes referred to as a "jewel," is essentially flat metal or plastic element. Although the element 16 is referred to as a "jewel," the element is not a gem stone.

Figure 5:
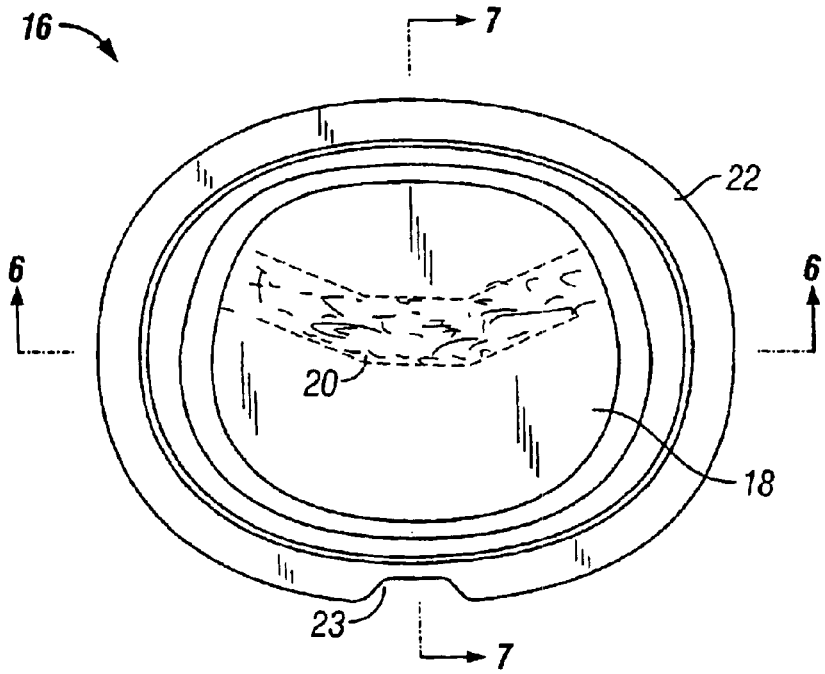
FIG. 5 is a plan view of the ornamental element molded onto the key of FIG. 1.
Figure 6:
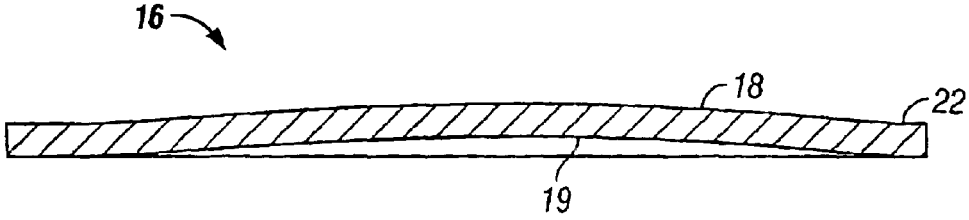
FIG. 6 is a section view taken along the line 6—6 of FIG. 5.
Figure 7:
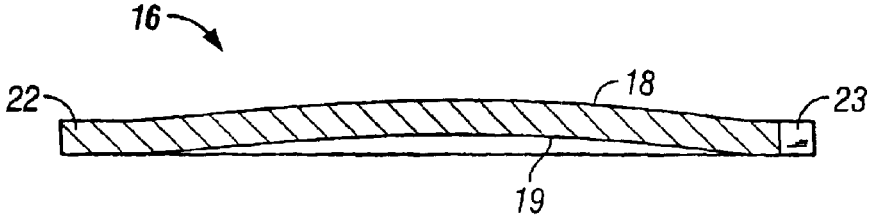
FIG. 7 is a section view taken along the line 7—7 of FIG. 5.

Referring to FIGS. 5–7, in one embodiment, the decorative element 16 is in the form of a thin bowed disk which is generally oval in shape. The element 16 has an outer surface 18 and an inner surface 19. The outer surface 18 is generally convex in shape. The inner surface 19 of the element 16 is concave to facilitate mounting of the element on the undermold. While in a preferred embodiment, the element 16 is generally oval in shape, the element can be generally circular or dome shaped, in the manner of element 106 shown in FIGS. 17 and 18, rectangular with a raised or domed center, in the manner of element 108 shown in FIGS. 19 and 20, or can be of other geometric shapes, such as triangular, octagonal, etc. The ornamental elements 106 and 108 can include indicia (not shown) on the outer surface in the manner of element 16.

The indicia 20 can be printed or otherwise reproduced on the outer surface 18 of the element 16 in a central portion thereof. The element 16 has a peripheral edge 22 surrounding the indicia bearing central portion of the element. The peripheral edge 22 includes a notch 23.

The element 16 is dimensioned to fit on the surface of one side of the key on which the element is mounted. In one embodiment, the element 16 is of material such as 1050 aluminum the thickness of which is approximately 0.3 millimeters. The element is approximately 15 millimeters in length and approximately 12.4 millimeters in width. The width of the peripheral edge is approximately 1 millimeter.

Referring to FIGS. 1–4, the head portion 12 is formed of a plastic material 24 which is molded onto the heel portion 15 of a key blank 13 which includes shank portion 14. The heel portion 15 of the key blank 13 is generally arcuate in shape and includes an end portion 21 that extends generally perpendicular to the axis of the shank portion 14 of the key blank 13. The key blank 13 preferably is made of a substantially rigid metal as is the convention in the automotive industry. Brass is the most common metal used to construct vehicle ignition keys because of its manufacturability, cost and compatibility with the tumblers of the lock. The shank portion 14 of the key is milled at 17 to match the keyway of a vehicle ignition lock. The shank portion 14 can include bits in the conventional manner to engage tumblers of the lock. The thickness of the rigid metal portions of the shank portion 14 and the heel portion 15 of the key 13 blank are substantially uniform except, of course, at locations 17 at which the milling has been preformed.

Figure 4:
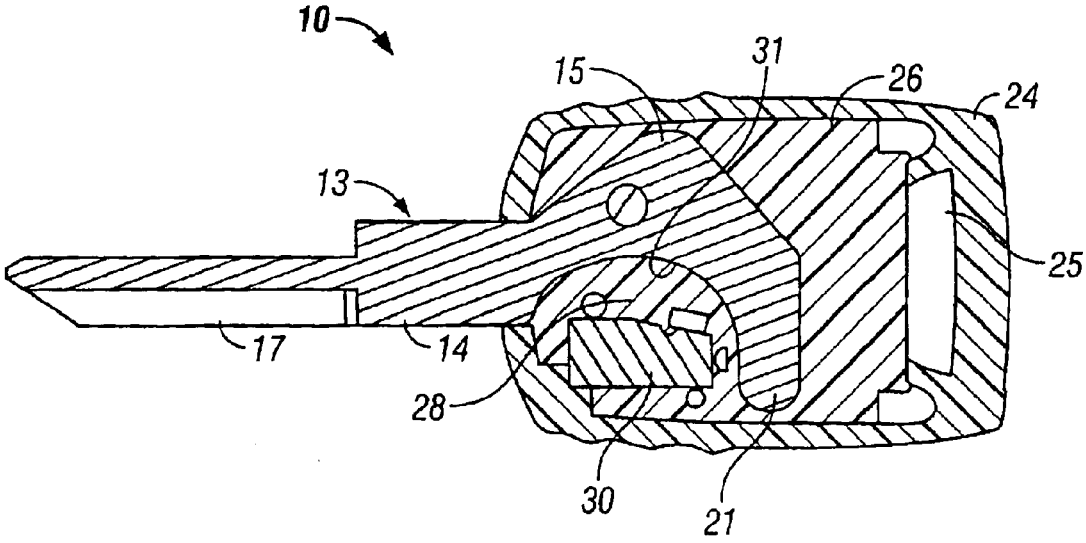
FIG. 4 is a section view taken along the line 4—4 of FIG. 2.
Figure 10:
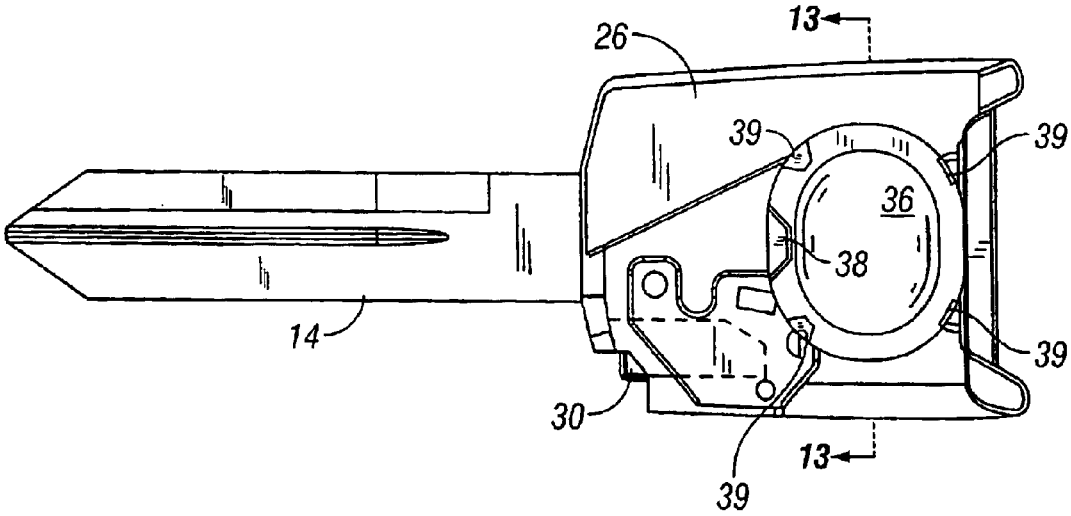
FIG. 10 is a side view of the vehicle key of FIG. 1 prior to overmolding.
Figure 11:
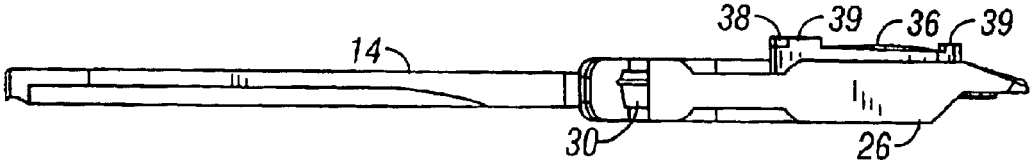
FIG. 11 is a bottom view of the vehicle key of FIG. 1 prior to overmolding.
Figure 12:
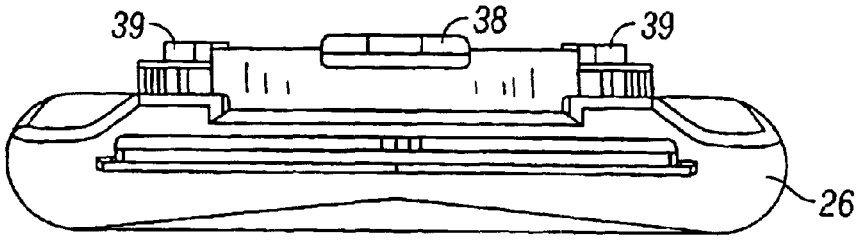
FIG. 12 is an end view of the vehicle key of FIG. 1 prior to overmolding.
Figure 13:
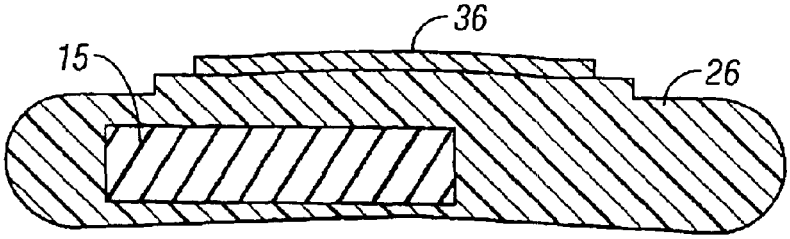
FIG. 13 is a section view taken along the line 13—13 of FIG. 10.

Referring to FIGS. 4 and 10, in one preferred embodiment, the key 10 further includes a transponder 30 which provides an electronic interlock for a vehicle ignition lock in the manner known in the art. The transponder 30 is located within an arcuate recess 28 formed in part by the arcuate edge 31 of the heel end 15 of the key blank 13, with the heel end 15 partially encircling the transponder 30. The arcuate shape of the heel portion 15 of the key blank 13 provides increased structural strength for the head portion 12 of the vehicle ignition key 10.

In one preferred process, the vehicle ignition key 10 is produced using a two-stage molding process. In the first stage of the process, the transponder 30 initially is secured to the key blank 13 by a plastic material 26 which is molded over at least a portion of the heel 15 of the key blank, forming an undermold 26, shown in FIGS. 4 and 10, for example. The undermold 26 frames and supports the transponder on the heel end 15 of the key blank 13 within the head portion 12 of the key 10. The undermold 26 can at least partially encapsulate the transponder as shown in FIG. 10 where encapsulated portions of the transponder are represented by a dashed line, or can be molded over only small portions of the transponder. The first stage of the process also produces a mounting surface 36 for mounting the element 16. Preferably, the mounting surface 36 is complementary in shape to the inner surface 19 of the element 16. The undermolding process secures the transponder to the key blank.

The second state of the process includes positioning the element 16 on the mounting surface 36 and molding a second material over the transponder 30, the undermold 26 and the peripheral edge of the element 16, forming an overmold. The overmold material 24 encapsulates the transponder 30 and secures the peripheral edge 22 of the element 16 to the key, trapping the peripheral edge between the overmold material 24 and the undermold material 26 as shown in FIG. 3, for example.

The overmold 24 is formed to include a recessed portion 34 in which is located the element 16. The overmolding process also encloses or encapsulates the transponder 30 and defines the primary finger gripping surface for a user of the key 10. In addition, the overmold 24 covers cavities or marks left by transponder positioners in the mold and flaws, such as blemishes, pinholes, and the like in the undermold as is known in the art.

In accordance with the invention, the plastic material 24 which forms the overmold is used to secure the element 16 to the head 12 of the key 10. In preferred embodiments, a portion of the overmold extends around the entire outer peripheral edge 22 of the element 16. However, the overmold can be formed to contact only a portion of the element, depending upon the shape and/or configuration of the element. In another embodiment, the overmold can contact the element solely along only a portion of its peripheral edge. In a further embodiment, the element has a center opening including an inner peripheral edge. In this embodiment, the overmold contacts the element along a portion of its inner peripheral edge or along the entire inner peripheral edge.

While the vehicle ignition key 10 includes a transponder in one preferred embodiment, the use of a molding process to secure the ornamental element 16 to a key can be used for keys which do not include a transponder. In one such embodiment, securing the element 16 to the key blank is facilitated by an undermold 26 which is formed to have a mounting surface 36 in the manner described for key 10. In another embodiment, the ornamental element is temporarily held in place on the key blank 13 by a rigid support which, in turn, is attached to the key blank. In either case, the overmold material 24 is used to secure the element to the key blank.

First Stage Processing

Figure 8:
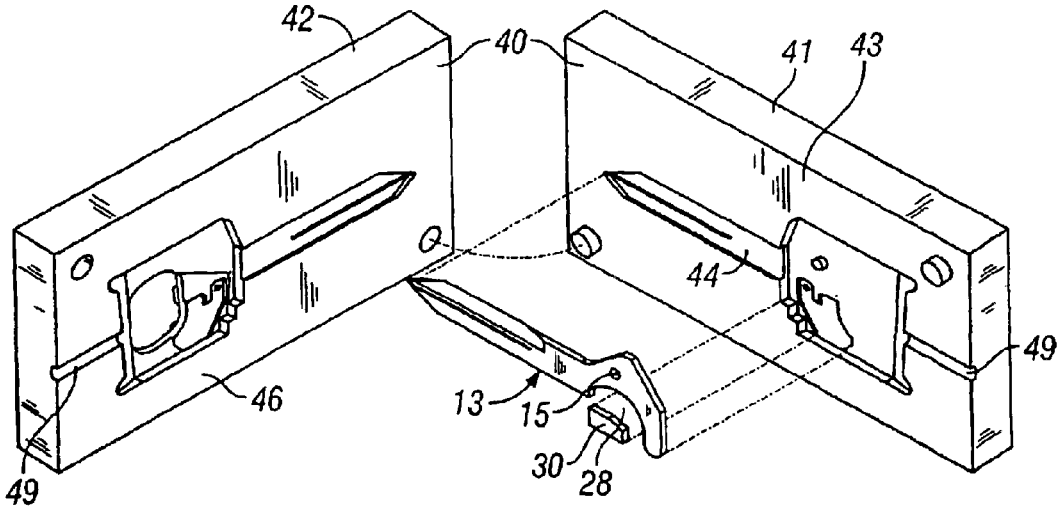
FIG. 8 is an exploded view of mold set for producing the undermold.
Figure 9:
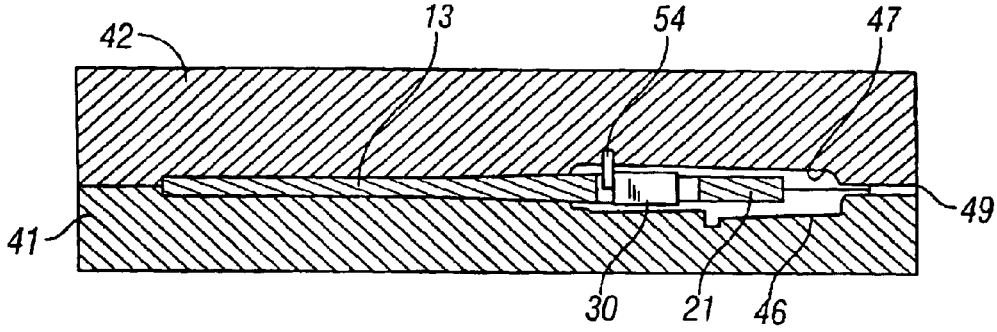
FIG. 9 is a section view of the mold set for producing the undermold.

Considering the process in more detail, with reference to FIGS. 8 and 9, the first stage of the molding process is performed using a mold set 40 which includes mold tools 41 and 42. First the key blank 13 is positioned in a recess 44 in surface 43 of mold tool 41. Then, the transponder 30 is positioned on the mold tool 41, located within the arcuate portion of the heel end 15 of the key blank 13.

After the transponder 30 is placed in the recess 28 (FIG. 4) defined by the heel portion 15 of the key blank, the second mold tool 42 is closed on the first mold tool 41 to encompass the key blank 13 and the transponder 30 as shown in FIG. 9. The mold tools 41 and 42 define mold cavities 46 and 47 that cooperate to produce the desired shape for the undermold 26. The mold set 40 can include locators 54 for holding the transponder 30 in position in the mold to prevent the transponder from moving within the mold during the injection of the first plastic material into the mold as is known in the art.

Then, the first plastic material 26, in liquid form, is injected into the mold set through a gate 49 of the mold set 40. The plastic material 26 forms the undermold which surrounds at least a portion of the transponder 30 and the heel 15 of the key blank and which integrally secures the transponder to the heel end of the key. In addition, the first molding stage which molds the undermold material 26 onto the metal key blank 13 (FIG. 4) also forms the undermold 26 to include the mounting surface 36 onto which the element 16 subsequently is placed.

Referring also to FIGS. 10–13, in one embodiment, the mounting surface 36 is generally convex in shape. The contour of the mounting surface 36 preferably is complementary to the contour of the inner surface 18 of the element 16. The mounting surface 36 includes an indexing member 38 and a plurality of small projections or locating pins 39. The indexing member 38 is formed near one end of the mounting surface 36, adjacent to the shank of the key blank. The indexing member is received in the notch 23 in the element 16 when the element is placed on the mounting surface. The indexing member 38 substantially prevents side-to-side movement of the element 16 during the second stage of the molding process. The projections 39 are disposed around the periphery of the mounting surface and retain the element 16 in place on the mounting surface 36 during the overmolding step in the second stage of the process. The projections 39 are formed along the periphery of the mounting portion 36 and center the element on the mounting surface 36.

The first plastic material is allowed to cool, securing the transponder 30 to the key blank.

Second Stage Processing

Figure 14:
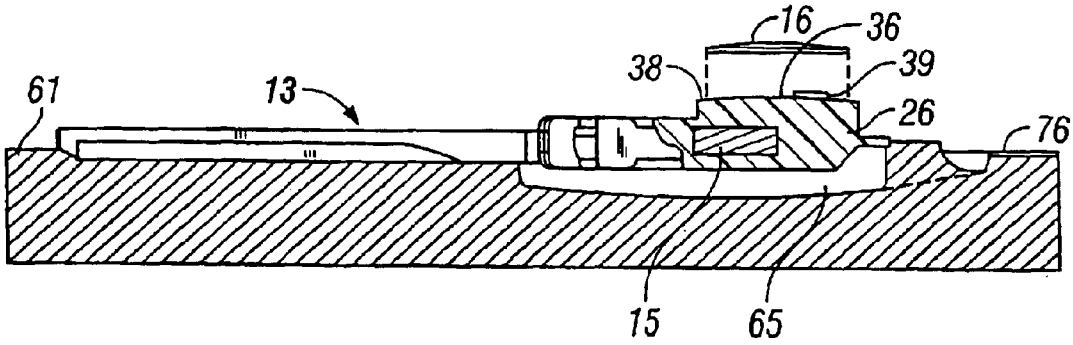
FIG. 14 is a side section view of a mold tool of a mold set for producing the overmold with the undermolded key shown located in the mold tool prior to positioning the ornamental element thereon.
Figure 15:
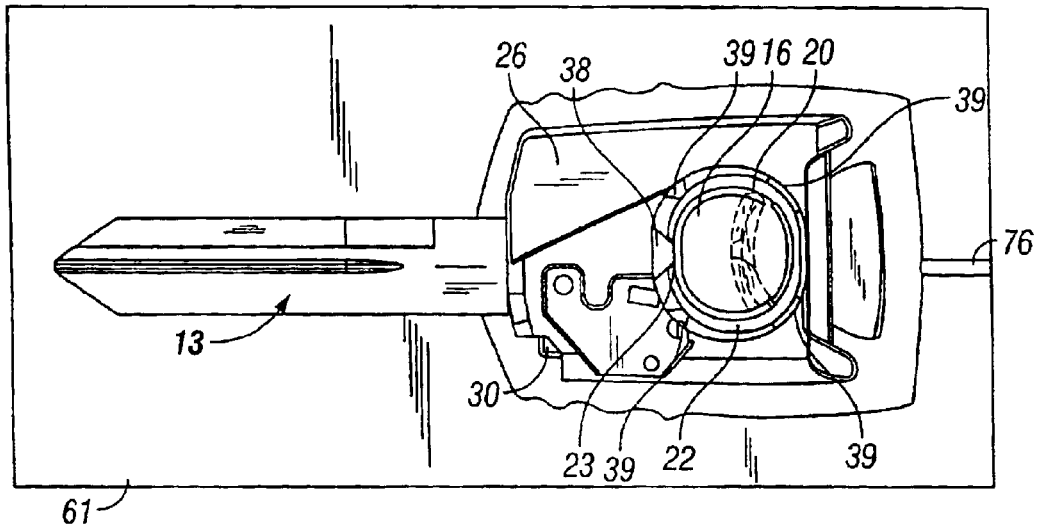
FIG. 15 is a top view of the mold tool of FIG. 14 with the ornamental element positioned on the undermolded key.
Figure 16:
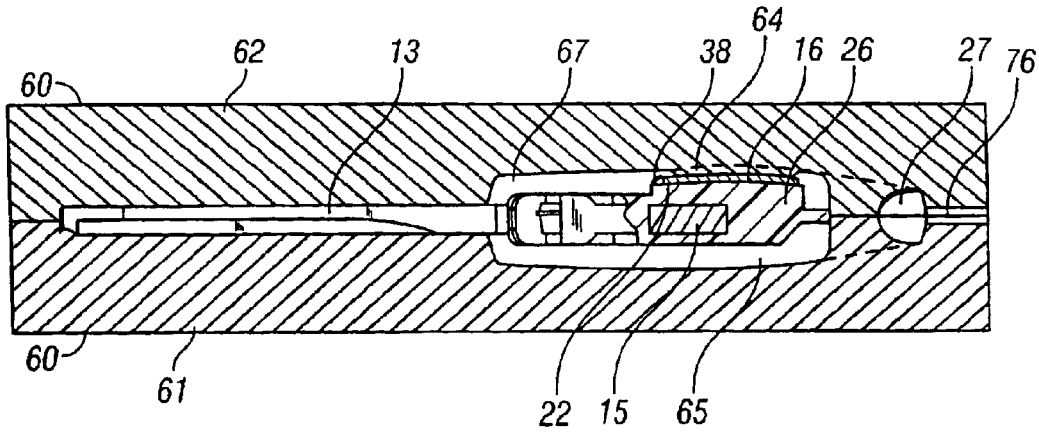
FIG. 16 is a section view of the mold for producing the overmold with the undermolded key therein prior to overmolding.

Referring to FIGS. 14–16, then, the key blank 13 and the transponder 30 secured to the key blank by the undermold material 26, are removed as a unit from the first mold set 40 and positioned in a mold tool 61 of a second mold set 60. The mold set further includes mold tool 62 (FIG. 16). The mold tools 61 and 62 define mold cavities 65 and 67 of the second mold set 60. The mold set 60 forms the overmold material 24 to the shape of the key head 12 as shown in FIGS. 1–3, for example.

The key blank 13 with the transponder 30 secured thereto by the undermold material 26 is positioned in the mold tool 61, with the indexing member 38 located distal to the gate 76 through which the plastic material 24 is introduced into the mold set 60. The element 16 is placed on the mounting surface 36. The element is aligned so that the indexing member 38 is received in the notch 23 in the peripheral edge of the element 16 and the locating pins 39 engage the edge of the element 16 as shown in FIG. 15.

Then, the second mold tool 62 of the mold set 60 is closed on the first mold tool 61. In one embodiment, a portion 64 of the mold tool 62 covers the center portion of the element 16 so that only the peripheral edge 22 is exposed within the mold cavity 67 to be covered by the overmold material 24. The second plastic material 24, in liquid form, is injected into the mold cavities 65 and 67 of the mold set 60 through gate 76 to produce the overmold as an outer shell which covers the transponder 30, the heel end 15 of the key blank 13 and the undermold 26 and covers at least a portion of the element 16.

The undermold material 26 forms a base for molding the overmold material 24 and as such, aids in securing the overmold material 24 to the key. In one embodiment, the second plastic material 24 is different from first plastic material 26. Preferably, the second plastic 24 is softer than the first plastic material 26. However, the second plastic material 24 can be harder than the first plastic material 26 or the second plastic material 24 can be the same as the first plastic material 24. In one embodiment, the first plastic material 24 is polypropylene and the second plastic material 26 is a thermoplastic rubber, such as Santoprene material.

In the second molding step, the overmold 24 which is produced encapsulates a portion of the element 16, thereby retaining the element 16 in place on the key 10. In one embodiment, a portion of the overmold material 24 covers the entire peripheral edge 22 of the element 16. However, the entire outer surface of the element 16, including the indicia 20, with the exception of the peripheral edge 22, is exposed, because the mold tools 61 and 62 prevent material 24 that forms the overmold from covering this area of the element.

Figure 21:
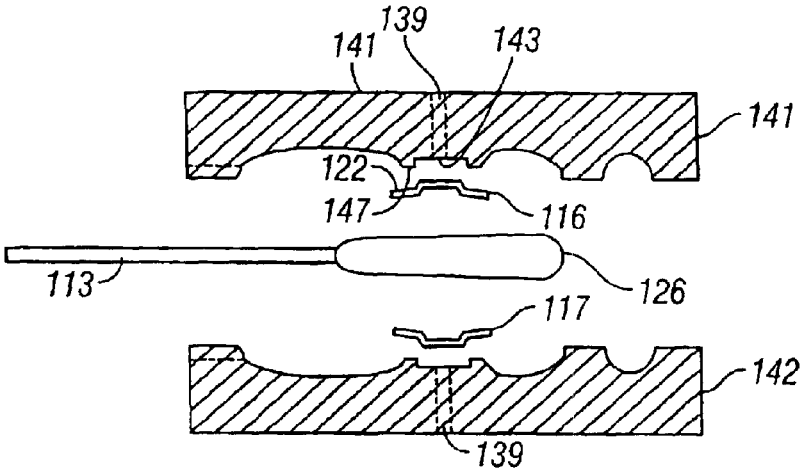
FIG. 21 is a simplified representation of a mold set for molding one or more ornamental elements to an undermold on a key blank in accordance with the invention.

In accordance with a further embodiment, the mold is used additionally as a locating device for placement of an ornamental element. Referring to FIG. 21, in this embodiment, the undermold 126 (or key blank 113) is not used for locating an ornamental element 116, but rather is used only to support the element 116 in the formed key assembly. One of the mold tools 141 includes a bore 139 which is connectable to a source of a vacuum. The ornamental element 116 is loaded directly into the mold tool 141 to achieve the optimum locating method for the element 116. Vacuum holds the element against an inner surface 143 of the mold tool 141 during the molding process. The peripheral edge 122, or a portion of the peripheral edge, of the element 116 is held against a raised surface 147 of the mold tool 141. The other mold tool 142 of the mold set is closed on mold tool 141. Then, the undermold material (not shown) is introduced into the mold set and the element 116 is overmolded onto the undermold. The peripheral edge 122 of the element 116 extends outwardly beyond the raised surface 147, allowing the peripheral edge 122 to be trapped between two "layers" of the overmold material in the manner shown for the embodiment illustrated in FIG. 23. An ornamental element can be overmolded to one or both sides of a key or other support, as shown in FIG. 21 which includes elements 116 and 117 located on opposite sides of the undermold. Moreover, this technique also can be used in a one-stage molding process without a key blank as illustrated in FIGS. 22 and 23.

Figure 22:
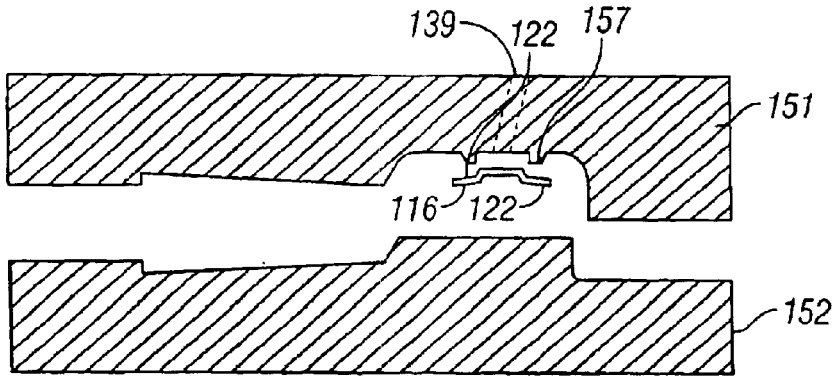
FIG. 22 is a simplified representation of a mold set for molding an ornamental element into a plastic housing in a single stage molding process.
Figure 23:
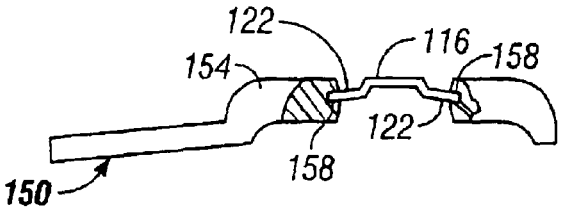
FIG. 23 is a side view, partially broken away, illustrating a plastic housing including a molded in ornamental element.

Referring to FIGS. 22 and 23, in another embodiment, the element 116 is molded directly onto a member 150, such as a housing, that is being molded of a plastic material 154. Mold tool 151 includes a bore 139 which is adapted to be connected to a source of vacuum for holding the element 116 to the mold tool 151 during the molding process. Mold tool 152 is closed on mold tool 151 and plastic material is introduced into the mold. The plastic material flows around the edges 122 of the element 116 on both sides thereof, securing the ornamental element to the member 150, as shown in FIG. 23. Raised surfaces 157 of mold tool 151 allow the peripheral edge 122 of the element 116 to be trapped in a groove 158 formed by the overmold material, as illustrated in FIG. 23.

Figure 24:
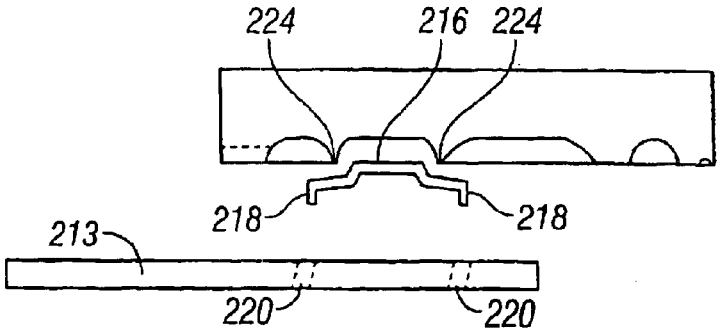
FIG. 24 is a simplified representation of a mold tool of a mold set for molding an ornamental element directly onto a key blank.

Referring to FIG. 24, in a further embodiment, the element 216 includes one or more prongs or projections 218 on one or more sides. The ornamental element 106, shown in FIG. 17, and the ornamental element 108, shown in FIG. 19, include such prongs, which are labeled 112 and 114, respectively. The prongs 218 are received in openings 220 in the key blank 213 for locating the element 216 during the molding process. In addition, the element 216 can be constrained on at least two sides by the mold, as indicated at 224. Plastic material is then injected into the mold, securing the ornamental element 216 to the key blank 213 in a single-stage molding process.

Figure 17:
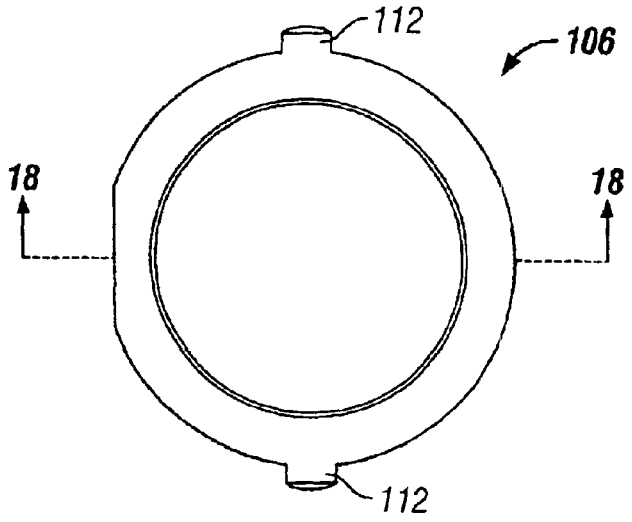
FIG. 17. is a bottom plan view of a further embodiment of an ornamental element.
Figure 18:
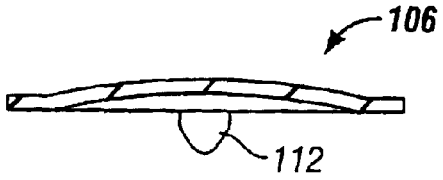
FIG. 18 is a section view taken along the line 18—18 of FIG. 17.
Figure 25:
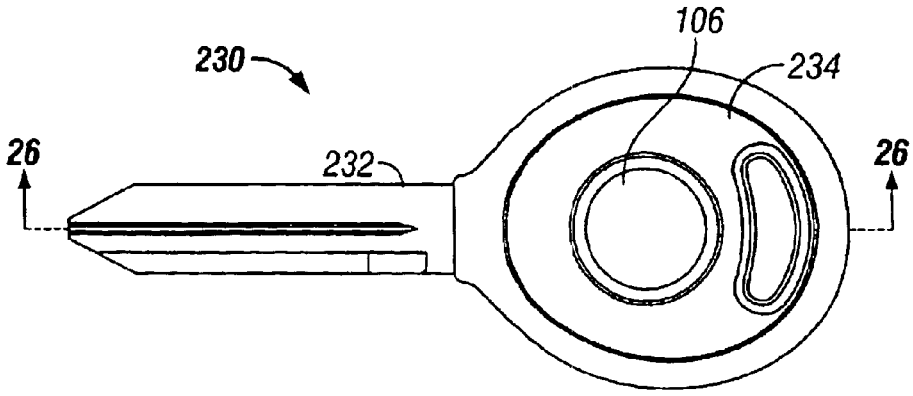
FIG. 25 is a side view of a key including the ornamental element of FIG. 17 molded directly onto the key blank of the key.
Figure 26:
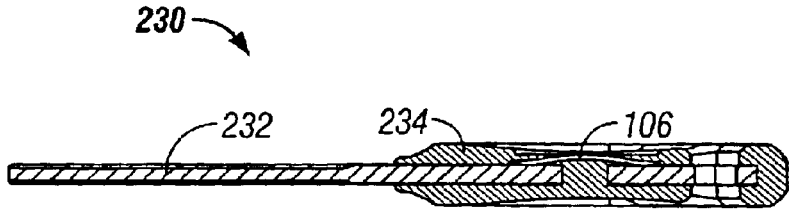
FIG. 26 is a section view taken along the lines 26—26 of FIG. 25.

FIGS. 25 and 26 illustrate a key 230 which does not include a transponder and wherein the domed element 106 shown in FIG. 17 (or alternatively, the rectangular element 108 of FIG. 19) is molded directly onto a key blank 232 by a plastic material 234 in a one stage molding process. In this embodiment, the prongs 112 of the element 106 are received in openings in the key blank, corresponding to the openings in key blank 213 (FIG. 24). Alternatively, the element 16 of FIG. 5, which does not include prongs, can be molded onto the key blank.

Figure 19:
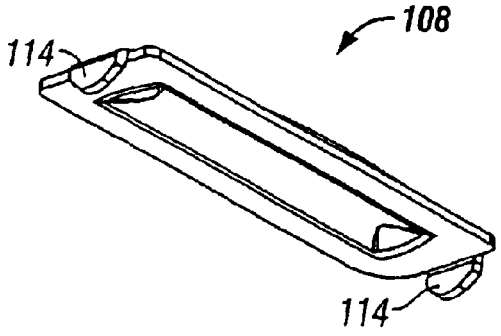
FIG. 19 is a bottom isometric view of a further embodiment of an ornamental element.
Figure 20:
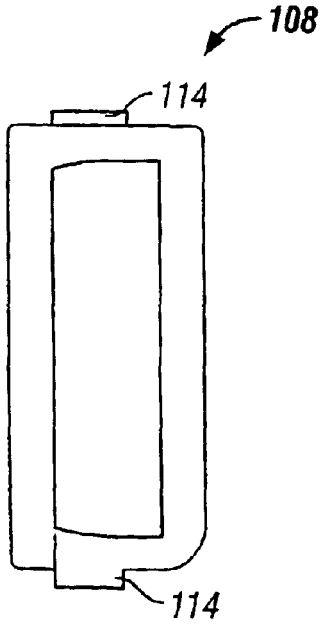
FIG. 20 is a plan view of the ornamental of FIG. 19.
Figure 27:
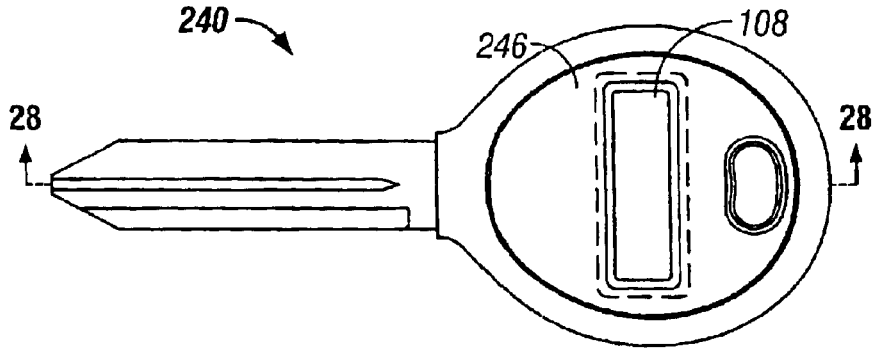
FIG. 27 is a side view of a key including the ornamental element of FIG. 19 molded onto an undermold portion of the key.
Figure 28:
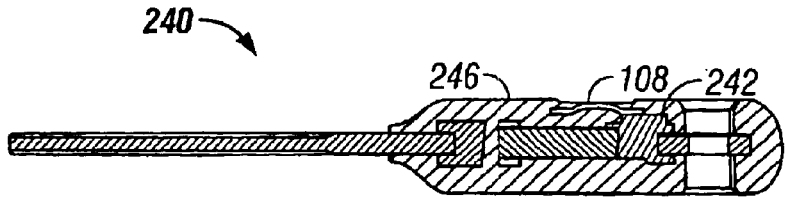
FIG. 28 is a section view taken along the lines 28—28 of FIG. 27.

FIGS. 27 and 28 illustrate a key 240 which includes a transponder (in the manner of key 10 shown in FIG. 4) and wherein the rectangular element 108 shown in FIG. 19 (or alternatively the domed element 106 of FIG. 17) is molded directly onto the undermold 242 by an overmold material 246 in the second stage of a two-stage molding process. In this embodiment, the prongs 114 are received in openings formed in the undermold 242 in the first stage of the molding process to locate and maintain the element in position on the undermold during the second stage of the molding process. Alternatively, a element (not shown) which does not include prongs, can be molded onto the undermold 242. The use of a molding process to secure an ornamental element, such as elements 16, 106, 108, 116, 216 to a key results in a much more secure connection between the ornamental element and the key than is obtained by the prior art technique of using an adhesive.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope, of the present invention.

What is claimed is:

1. A method of making a key including a head portion containing an ornamental element, the ornamental element including a first surface and an oppositely-facing second surface having a first portion and a second portion, said method comprising:

providing a key;

providing a mounting surface for the ornamental element on a portion of the key;

positioning the ornamental element on the mounting surface with the first surface facing the mounting surface; and placing a material over the portion of the key and the first portion of the second surface of the ornamental element to cover at least a majority of a peripheral edge of the ornamental element, to secure the ornamental element to the key, and to leave exposed the second portion of the second surface of the ornamental element, wherein placing the material over the portion of the key includes molding the material over the portion of the key and the first portion of the second surface of the ornamental element.

2. The method according to claim 1, further comprising covering a center portion of the ornamental element during the step of placing the material, whereby only the peripheral edge of the ornamental element is covered by the material.

3. The method according to claim 1, further comprising securing the ornamental element to the mourning surface by trapping a portion of the peripheral edge of the element between the mounting surface and the material.

4. The method according to claim 1, wherein the material is plastic.

5. The method according to claim 1, wherein:

the material is a first material;

the mounting surface is a surface of a second material; and placing the material over the portion of the key includes placing the first material over a portion of the second material.

6. A key, comprising:

a key blade;

a head portion;

a partially exposed ornamental element including a first surface and a second surface on oppositely-facing sides of the ornamental element, the second surface having a first portion and a second portion;

a mounting surface on a portion of the key, the first surface of the ornamental element positioned on the mounting surface; and a material molded over the head portion of the key and the first portion of the second surface of the ornamental element, the material covering at least a majority of a peripheral edge of the second surface, securing the ornamental element with respect to the head portion of the key, and leaving the second portion of the ornamental element exposed.

7. The key according to claim 6, wherein the first portion of the ornamental element is at least a portion of the peripheral edge of the ornamental element.

8. The key according to claim 6, wherein the material is a plastic material.

9. The key according to claim 6, wherein:

the ornamental element further comprises one of a recess and a projection; and the mounting surface includes another of the recess and the projection, the projection being received in the recess.

10. The key according to claim 6, wherein the head portion of the key is part of the key blade.

11. The key according to claim 10, wherein:

the material is a first material; and the head portion of the key is at least partially defined by a second material coupled to the key blade.

12. A key made according to the method of:

providing an ornamental element including a first surface and a second surface, the first and second surfaces on oppositely-facing sides of the ornamental element, the second surface having a first portion and a second portion, the first portion defining at least a majority of a periphery of the second surface;

providing a mounting surface on a portion of the key, the first surface of the ornamental element positioned on the mounting surface;

positioning the ornamental element with respect to a blade of the key;

covering a portion of the key blade with a material to at least partially define a head portion of the key;

covering the first portion of the second surface of the ornamental element with the material;

leaving the second portion of the second surface of the ornamental element visible; and securing the ornamental element to the key blade by covering the first portion of the second surface of the ornamental element.

13. The key made according to the method claimed in claim 12, further comprising trapping the first portion of the second surface between the material and the key blade.

14. The key made according to the method claimed in claim 12, further comprising leaving the second portion of the second surface of the ornamental element exposed.

15. The key made according to the method claimed in claim 12, wherein covering a portion of the key blade with the material and covering the first portion of the second surface of the ornamental element with the material comprise molding the material over the portion of the key blade to at least partially define the head portion of the key and molding the material over the first portion of the second surface of the ornamental element, respectively.

16. A method of making a key including a head portion containing an ornamental element, the ornamental element including a first surface and an oppositely-facing second surface having a first portion and a second portion, said method comprising:

providing a key;

providing a mounting surface for the ornamental element on a portion of the key;

positioning the ornamental element on the mounting surface with the first surface facing the mounting surface; and placing a material over the portion of the key and the first portion of the second surface of the ornamental element to cover at least a majority of a peripheral edge of the ornamental element, to secure the ornamental element to the key, and to leave exposed the second portion of the second surface of the ornamental element; and covering a center portion of the ornamental element while placing the material over the portion of the key and the first portion of the second surface of the ornamental element, whereby only the peripheral edge of the ornamental element is covered by the material.

17. The method according to claim 16, wherein placing a material over the portion of the key includes molding the material over the portion of the key and the first portion of the second surface of the ornamental element.

18. The method according to claim 16, further comprising securing the ornamental element to the mounting surface by trapping a portion of the peripheral edge of the element between the mounting surface and the material.

19. The method according to claim 16, wherein the material is plastic.

20. The method according to claim 16, wherein:

the material is a first material;

the mounting surface is a surface of a second material; and placing the material over the portion of the key includes placing the first material over a portion of the second material.

* * * * *